United States Patent [19]

Terrell

[11] 4,335,663

[45] Jun. 22, 1982

[54] THERMAL PROCESSING SYSTEM

[75] Inventor: George C. Terrell, Foxboro, Mass.

[73] Assignee: Conservation Technologies, Inc., Providence, R.I.

[21] Appl. No.: 95,494

[22] Filed: Nov. 19, 1979

[51] Int. Cl.[3] ..... F23D 1/02

[52] U.S. Cl. ..... 110/264; 110/215; 110/216; 431/173; 431/352

[58] Field of Search ..... 110/263, 264, 265, 347, 110/215, 216; 431/352, 173; 55/95

[56] References Cited

U.S. PATENT DOCUMENTS

| | | | |
|---|---|---|---|
| 2,617,405 | 11/1952 | Keller | 110/264 X |
| 2,865,344 | 12/1958 | Firl | 110/264 X |
| 2,917,011 | 12/1959 | Korner | 110/264 |
| 3,137,338 | 6/1964 | Biber et al. | 431/173 X |
| 3,656,441 | 4/1972 | Grey et al. | 110/215 |
| 4,206,712 | 6/1980 | Vatsky | 110/264 |

*Primary Examiner*—Edward G. Favors

*Attorney, Agent, or Firm*—Salter & Michaelson

[57] ABSTRACT

A thermal processing system and method which is directed to the controlled high rate of exchange of thermal energy between solid matter or liquids and a gas which functions simultaneously as the thermal energy transport medium and the physical transport medium. The system includes a primary processing device which is provided with means for introducing the solid or liquid matter in a finely divided state and a means for introducing the carrier gas so as to create a very high velocity stream together with means for supplying and/or controlling the thermal energy input(s) to the system by operating on such carrier gas. The system also includes means for continuously removing the resulting products (solids, liquids, gases and in some instances, energy) in such a way that a continuous stream process results. The system is also provided with any necessary or desirable auxiliary devices to ensure that all discharges from the process are substantially cleaner than required by any applicable environmental standards.

5 Claims, 2 Drawing Figures

THERMAL PROCESSING SYSTEM

BACKGROUND AND SUMMARY OF THE INVENTION

This invention relates to certain kinds of thermal processes and more particularly to a novel system and method for the efficient execution of such.

There are several types of processes to which the present system is applicable. Examples of such include treatment of metal sulfide ores for removal of sulfur and combustion of organic materials, such as sewage sludges, for heat production. For example, some metal ores of commercial significance, such as ores of copper, lead and zinc, occur in nature primarily as sulfides. An initial step in the recovery of the metal in such ores is a roasting step which can be accomplished using the subject system in which the metal sulfide is thermally decomposed, the sulfur being removed in the form of sulfur dioxide. Also, waste organic material, such as sawdust and other similar by-products can be utilized for their fuel value by pyrolysis. In such a process carried out by the subject system, combustible gases are driven off by thermal decomposition. In addition, the subject system may be used in the treatment of sewage sludges in which the water is to be removed and the organic content reduced by incineration. These processes are cited as examples only and this recitation is not intended to limit the potential scope of application of the invention.

A common feature of all potential applications is that they either require a substantial energy input or, where exothermic processes are involved, require close and continuous temperature control. Conventional systems and apparatus, such as rotary kilns, multiple hearth furnaces, and fluidized bed incinerators, are generally designed to effect this energy input or control primarily through thermal conduction, convention, or diffusion. A description of the mode of operation of these conventional devices will serve to describe the essential differences between such devices and the present invention.

A rotary kiln is a device in which a long cylindrical chamber, horizontally disposed, is made to rotate about its axis. The inner surface of the cylinder is fitted with radial vanes. Solid matter placed into the cylinder is tumbled and mixed by the action of the vanes. By tilting the axis of the cylinder, the solid matter is also caused to progress from one end of the cylinder to the other as it is tumbled. By flowing hot gases through the cylinder at the same time, energy may be transferred from the hot gases to the solid matter.

A multiple hearth furnace is comprised of a series of circular hearths arranged one above the other. The solid matter is made to traverse the furnace from top to bottom, transferring from hearth to hearth while the hot gases flow from the bottom to the top. Each hearth is provided with a radial slot and a radial bar, called a rabble arm, pivoted at the end which is located at the center of its hearth and caused to sweep around the hearth slowly. The material is deposited on the top hearth where it is exposed to the hot gases while it is slowly raked around the hearth by the rabble arm until it reaches the radial slot whereupon it falls through the slot to the hearth below. This process is repeated as many times as there are hearths. The combination of raking by the rabble arms and the process of transferring from hearth to hearth in the hot furnace area progressively exposes more and more of the solid matter to the hot atmosphere until the desired condition is attained.

A fluidized bed type or incinerator operates on a somewhat different principle. The desired high temperature atmosphere is created by heating a bed of fine sand to the desired temperature. This bed is caused to have the properties of a liquid by the buoyant forces developed by hot gases flowing upwardly through it, sometimes in conjunction with a mechanical vibrating force applied to the bottom of it. The solid matter to be processed, which must be in a finely divided form as presented to the bed, is injected into the bed, whereupon the mechanical forces of the moving sand particles cause it to be further fragmented and dispersed.

Despite the availability of the above equipment, there remains a need for a system in which such thermal processes can be carried out quickly, efficiently and with relatively minimal equipment outlays. It is accordingly a primary object of the present invention to provide a system which accomplishes the above objectives in a novel and continual manner.

These and other objects of the present invention are accomplished in part by the use of mechanical energy in an appropriate way to reduce the solid or liquid matter to a finely divided state, either prior to or coincident with the introduction of such matter to the carrier gas in order to create as large a surface area of contact as possible. The second essential part is that there be set up a reaction chamber through which the carrier gas stream and the finely divided solid or liquid matter may be caused to pass and such that carrier gas is caused to flow at such velocities that substantially all of the solid or liquid matter becomes entrained therein and such that a substantial fraction of the carrier gas is caused to pass through the reaction chamber two or more times before leaving the chamber system.

In order to provide desired interaction between the solid or liquid and the carrier gas, the system is virtually dependent on substantially complete entrainment of the solid or liquid and recirculation of a substantial portion of the material laden gas within the system. This is necessary to provide the desired boundary layer interaction between the material and the gas and also to provide the desired residence time of the material and the gas within the reactor system. As a result of a combination of these effects the system herein disclosed is operative for effecting substantially complete interaction between the liquid or solid particles and the carrier gas.

The device of the instant invention incorporates means for effecting the maximum possible rate of interaction without unnecessarily raising temperature utilizing two factors; (1) maximization of the specific surface area (surface to volume ratio) for the solid or liquid substance and (2) rapid renewal of the boundary layer at the interface between the gaseous and the solid or liquid phases. By optimizing these factors the instant invention provides an interaction system which is substantially more energy efficient than those systems previously known.

Other types of rate-enhancing results are achieved by the device of the instant invention. For instance, even though evaporation, which is an endothermic process, is rate-controlled primarily by temperature, it is also dependent upon the level of the vapor pressure in the boundary layer environment. Were the boundary layer stagnant, the vapor pressure would quickly build up to that level where no further evaporation could occur at any temperature. The more rapid the renewal of the boundary layer, the higher can be the difference in vapor pressure between the environment and the surface of the substance from which matter is being evaporated.

In the chemical reaction type of process, such as the oxidation of sulfide ores or the organic function of those waste water treatment sludges which contain organic material, the rate of reaction depends upon, in addition to temperature, the concentration of oxygen molecules in the boundary layer. Again, the more rapid the renewal of the boundary layer, the more rapid the reaction rate at any given temperature above the ignition level.

Further, improvements in efficient energy utilization are achieved by operating without refractory materials and limiting operation to temperatures within the limitations of certain special alloy steels and by utilizing reaction chambers of substantially reduced volumes.

A necessary element of such a system is that the carrier gas be driven through the reaction chamber by a fan or blower, capable of operating at the necessary temperatures and having sufficient power to set up and maintain the necessary gas velocities.

Alternate ways of physically creating the stated conditions may be suggested as illustrative of the application of the present invention.

In one proposed embodiment, the reaction chamber may be a vertical cylinder, the diameter of which is chosen such that the upward velocity of the carrier gas in the direction of the cylinder axis when introduced at the base of the cylinder is small enough that substantially all of the finely divided solid or liquid matter introduced at the top of the cylinder will be allowed to fall through the chamber under the influence of gravitational forces. The necessary entrainment conditions are created by causing the fan or blower to inject the carrier gas at the base of the cylinder tangential to the cylinder walls and at such velocity that a vortex is created in the reaction chamber in which the tangential component of velocity is anywhere from ten to twenty times the vertical component of velocity. The necessary recirculation condition is achieved by directing the exiting gases from the top of the reaction chamber to the suction intake of the fan or blower and equipping the output pressure discharge of the blower with an adjustable flow splitter, with part of the discharge being directed to exhaust from the system while the balance is directed to the input nozzles at the base of the reaction chamber.

Alternatively, the same objective may be achieved by utilizing a jet mill of particular construction as a reaction chamber. Such device has a substantially closed wall toroidal body and means for continually recycling a high temperature carrier gas stream therein such that as the material to be thermally processed is fed thereto, the gas stream reduces the solid particles thereof into a size range of particles which become entrained therein, and as the particles and the gas stream come in contact with each other, the desired contact and transfer of thermal energy occur. The toroidal flow path of the gas stream enables a portion thereof traveling about the inner confines of the toroidal body to be continually withdrawn from the air stream by tapping an exit port into the side wall of the jet mill. In this embodiment, the necessary carrier gas velocities are established by a pressure blower which injects such gas tangentially to the wall of the toroidal structure through nozzles which are sized to impart the desired velocities. The necessary recirculation condition is made to occur within the structure itself by controlling the geometry of the exit port.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE INVENTION

The present invention is not limited to one specific apparatus. Rather, it is composed of a number of specific process elements which can be combined in different ways to achieve the objects of the invention. The following description will outline apparatus in which the invention is embodied and from which the essential features of the invention will be brought out. In that regard, the combination of the following essential process elements comprises the invention:

1. Mechanical reduction of the solid or liquid material to be treated to very fine particle sizes of the order of 200 microns or less so as to provide extremely large material surface area.
2. Control of the temperature of the heater transfer atmosphere by pre-injection control of the carrier gases.
3. Conservation of energy by recirculation of a substantial fraction, i.e. greater than 50% of the preheated carrier gases within the reaction chamber.
4. Mechanical transport of the solid material through the system by entrainment in the stream of high velocity carrier gases.
5. Removal of the solid material from the system by the use of inertial forces.

Figure 1:
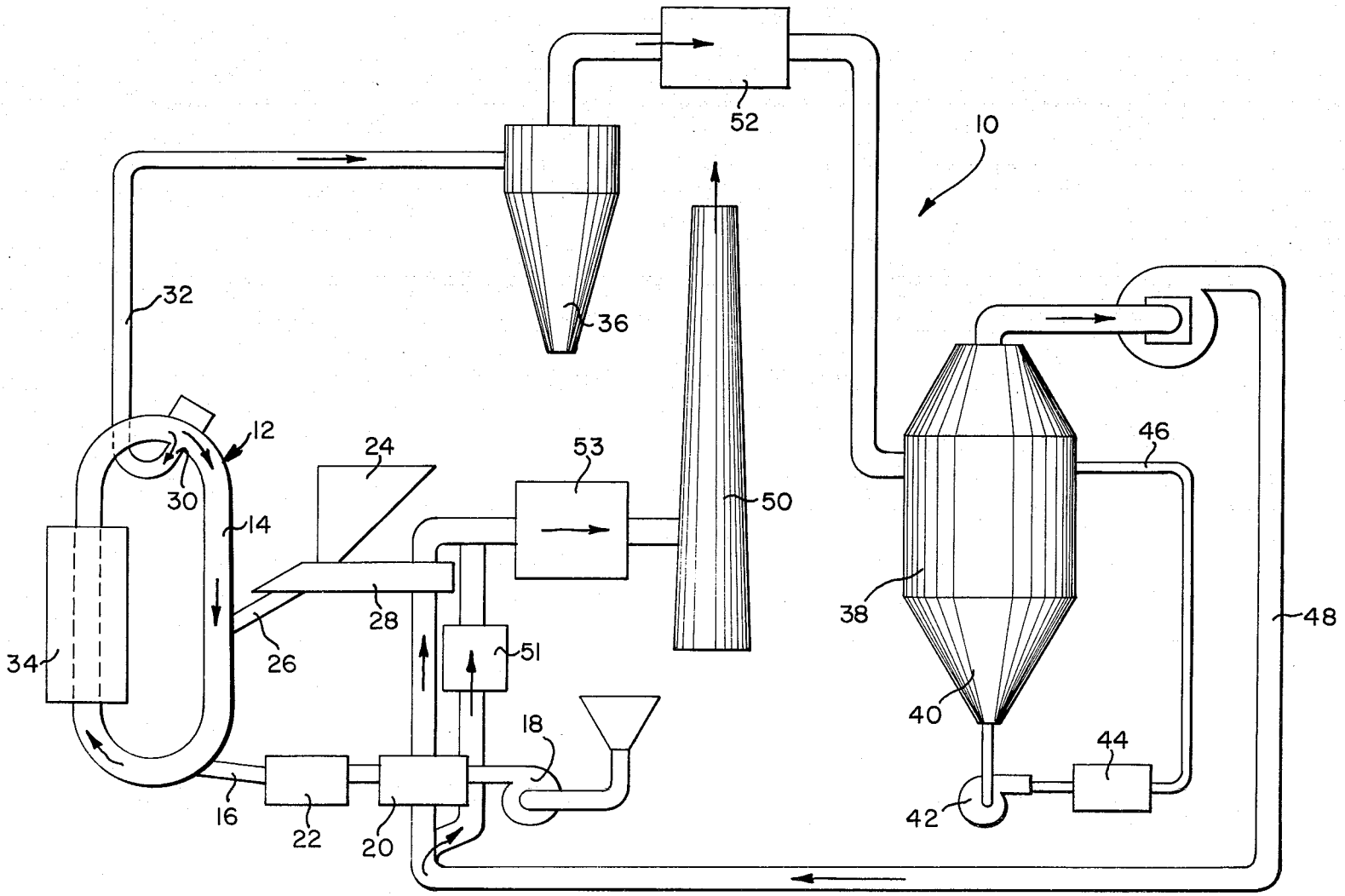
FIG. 1 is a schematic view of one particular equipment arrangement in which the present invention may be carried out.

Turning now to FIG. 1 of the drawings, a processing system 10 is depicted. Such system includes a primary reaction device 12 including a substantially closed wall toroidal chamber or body 14, in turn defining a cyclonic path in which a gaseous stream such as high temperature air may be cycled. Means, including nozzles, (not shown) enables gas from an entrance pipe 16 to be forced into the body 14 at a high velocity and at an angle so as to set up a turbulent primary gas stream which is caused to cycle about the interior portions of the body in the direction of the arrows shown. The inlet gas is driven by a blower 18 and, where necessary, suitably preheated by a preheater 20 as will hereinafter be more fully explained, and then raised as required to a final temperature by an auxiliary heater 22.

Solid material, which may be previously prepared in a finely divided state, or may be so rendered simultaneously with the feeding, is continuously fed into the body 14 in a position along one of the sides thereof upstream from the gas inlet 16. A supply reservoir 24 and inlet feeder 26 is provided for such purpose. Additionally, the material is preheated prior to its entrance into the body 14 by a preheater 28. As the material enters the chamber 14, it is moved directly into the circulating gas stream such that deagglomeration of the material occurs so as to form a plurality of discrete particles in a range of very small sizes, which in turn, upon exposure to the high temperature gases, rapidly come to temperatures equilibrium with the gases. During their cycle within the gas stream, the particles are broken down by size and classified by centrifugal force. The larger, i.e. heavier, particles remain on the outer periphery of the chamber 14 where the gas stream is at its highest velocity and the finer, i.e. lighter, particles tend to move and become entrained in the slower moving portions of the gas stream adjacent the inner walls of the chamber 14.

An exhaust port 30 is positioned at the inside of the upper portion of the chamber such that a portion of the slower moving gas stream may be removed therefrom via conduit 32. The velocity of the incoming gas as well as the dimensions of the chamber 14 and the outlet 30 are regulated such that flow rate of the circulating gas stream within the body 14 is considerably greater than the flow rate of gas continually entering and leaving the system via inlet 16 and outlet 30. A main stream of cycling gas having a mass flow rate in the range 4 to 5 times that entering and leaving the chamber 14 has been found to be particularly effective. Accordingly, the cyclonic chamber 14 forms a primary heat transfer device effective to continually and efficiently accomplish a number of useful functions involving heat transfer. Should any of the reactions involved cause the temperature of the circulating gases to rise to a level above a safe operating temperature range, a cooling unit 34 is provided on the upstream leg of the chamber 14 so as to reduce such temperature. The chamber 14 may be formed by a jet mill type flash dryer device such as that described in Bulletin 1000 published by the Aljet Equipment Co. of Willow Grove, Pennsylvania.

The continuously withdrawn gas stream may then be directed to a cyclone separator 36 of conventional construction in which the coarser particles are removed therefrom. The gas stream then continues to an afterburner 52 and/or to a gas-liquid contactor 38 in which any remaining particles are sequentially burned and scrubbed by contact with an appropriate liquid. The particles removed by such gas-liquid contactor 38 via the conical bottom 40 thereof are then pumped by pump 42 through a filter 44 and recycled to the contactor 38 via conduit 46. The gas-liquid contactor utilized is preferably that disclosed in co-pending application Ser. No. 968,572 filed Dec. 11, 1978, the disclosure of which is hereby specifically incorporated by reference into this application. Thereafter, the secondary gas stream is returned via conduit 48 to preheater 20 wherein a portion of the heat therein may be transferred to the make-up gas flow to the chamber 14 and thereafter passes to the preheater 28 so as to effectively raise the temperature of the incoming material. If transfer of energy in preheater 20 is not desired, the preheater may be bypassed to heat reclaimer 51. By preheating the inlet gases and incoming material by the returned secondary gas stream, not only is the added heat required to raise such to the desired temperature range minimal, but also the temperature of the return gas flow is reduced to a lower temperature prior to being exhausted from the system. It is also possible as a further option to insert a fabric filter system 53 at this point for final polishing of the exhaust gas since the temperatures have now been reduced to the point that a fabric filter becomes feasible.

Thereafter, the thus cleaned and cooled return gas flow is vented to the atmosphere through stack 50 at a substantially reduced temperature. Such equipment has particular utility for the treatment of waste sewage sludge but is not limited thereto. Accordingly, the thermal processing system and method of the present invention broadly includes the controlled high rate of exchange of thermal energy between solid matter or liquids and a gas which functions simultaneously as the thermal energy transport medium and the physical transport medium. Processes, the efficiency of which may be enhanced by such controlled high rate exchange, may be physical such as phase change (fusion or vaporization) or thermal decomposition (pyrolysis) or may be chemical in which a desired reaction is caused to take place between one or more components of the solid or liquid matter and one or more components of the carrier gas, or may be a combination of these processes (incineration).

EXAMPLE 1

A system was assembled in accordance with the constructional embodiment shown in FIG. 1 and tests were run utilizing a waste-water treatment sludge, the system being adjusted to function as an incinerating device in this instance. The sludge being processed was determined by analysis to contain 33.21% solids by weight and a net heat release value of 1499 BTU/lb. The sludge was injected into the preheated combustion chamber 12 by being forced by a progressive cavity pump against a back pressure of 50 psi through a ¼ inch diameter nozzle whereupon it was broken into a fine spray by compressed air at a pressure of 30 psi at the nozzle and directed so as to form a spray cone with an included angle of approximately 30°.

After reaction in the combustion chamber, the reacted products were directed to the cyclone separator 36 wherein the major portion of the ash was separated from the gases, the residue with the gases next flowing to the gas liquid contactor 38 in which the liquid medium was a nitrate-nitrite salt mixture with a melting point of 275° F. and an operating range of from 350° F. to 850° F. and in which 80% of the residue ash being carried by the gases were trapped. The relatively clean gases were then directed to heat exchangers (preheaters 20 and 28) in which a major portion of the heat energy was removed by the cold make-up air and the materials on their way to the combustion chamber, thus reducing the temperature of the hot gases to the level needed for safe operation of the fabric filter 53 by which the gases were given a final polishing.

The subject sludge was fed to the combustion chamber at a rate of 300 pounds per hour while at the same time the chamber was being supplied with heated air at a rate of 990 pounds per hour. This corresponds to a ratio of air to sludge of 3.3 to 1. Based on the organic fraction of the sludge (the combustible part) which was determined to be 63.8% by weight of the dry solids portion, the ratio of air to combustibles was 15.6 to 1.

The perimeter of the combustion chamber 14 was 15.8 feet and the velocity of the gases in the chamber was 11,600 FPM. At the same time, the velocity of the gases in the exit conduit duct 32, the diameter of which was 6 inches, was 2,920 FPM. This relationship indicates a recirculation rate of 3.97 to 1. With a velocity of 11,600 FPM (193.33 FPS), the transit time for one passage around the combustion chamber was 0.0817 seconds. With a recirculation ratio of 3.97 to 1, the mean residence time for a particle in the combustion chamber is 0.32 seconds.

Tests were conducted in which the percent completion of the combustion reaction was investigated as a function of the steady-state mean temperature of the exit gases from the combustion chamber. Percent completion was determined by measuring the amount of combustibles remaining in the ash.

For the particular material tested and for the air solids ratios given, it was determined that, with maximum possible heat being transferred to the make-up air from the flue gases (1030 BTU per minute), a minimum temperature of 900° F. was needed to maintain combustion and that this corresponded to a percent completion of combustion of 60%. At a temperature of 1000° F., combustion was 80% complete and heat feed-back had to be reduced to prevent the temperature from climbing. At 1100° F., combustion was 94% complete and all feed-back had to be removed to prevent the temperature from climbing.

In a conventional device, such as a multiple hearth furnace, utilized for this purpose, it is customary to operate at temperatures of 1400° F. and the average residence time for a particle of sludge traversing the device will be of the order of 20 minutes to allow for evaporation, temperature rise, ignition, and burn-out. At the same rate of feed as for the system incorporating the elements of this invention, namely 300 pounds per hour, it is obvious that the multiple hearth furnace must be large enough to hold in residence a total of 100 pounds of sludge. In contrast, the system reported herein, with a mean residence time of 0.32 seconds will be holding in residence at any instant of time only 0.09 pounds.

Accordingly, using the teachings of the present invention results in the capability of dramatic size reduction of equipment combined with the capability to achieve the desired results at a significantly lower temperature level (1100° F. as compared to 1400° F.).

Figure 2:
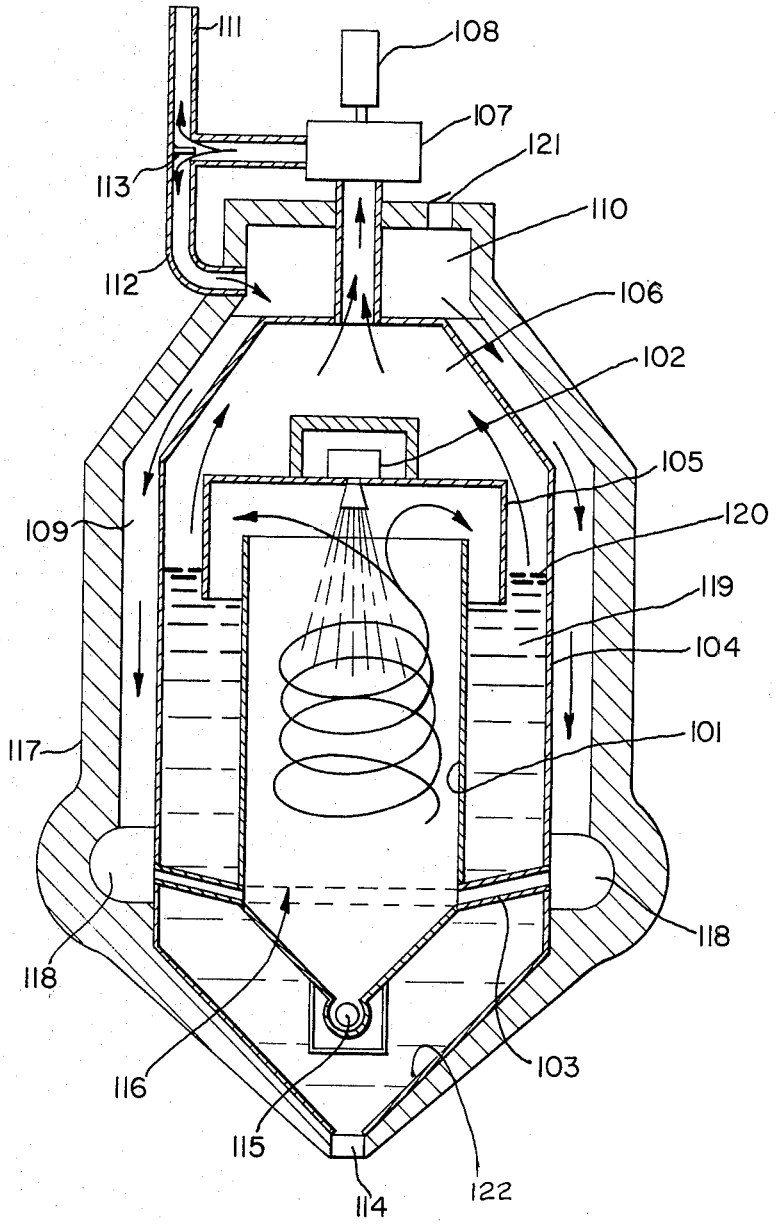
FIG. 2 is an elevational section of another constructional embodiment of the present invention.

Turning now to FIG. 2 of the drawings, an alternative constructional embodiment of the invention is shown. Therein a cylindrical reaction chamber 101 is disposed concentrically within a cylindrical outer shell 104. The space between the two cylinders is filled with a suitable high temperature scrubbing fluid 119 up to a predetermined level 120. This fluid serves as ascrubbing medium by the action of an interposed slotted scrubber baffle 105 and simultaneously serves as a heat transfer medium and a thermal ballast to moderate temperature excursions at the walls of the reaction chamber 101. Exhaust gas products are drawn from the reaction chamber 101 to an exhaust gas plenum 106 with the solid matter being separated from the gases at the scrubber baffle 105 by the action of centrifugal fan 107, in turn powered by the electric motor 108. The exhaust from the fan is divided into two streams by a variable position baffle flow splitter 113. One fraction of such exhaust stream is exhausted from the system through exit conduit 111, while the balance is returned to the gas plenum 110, by means of another conduit 112. The return gas plenum 110 is in physical contact with the exhaust gas plenum 106 to provide for the transfer of heat energy from the exhaust gas to the return gas. The return gas then flows via annular chamber 109 to an injection plenum 118, thence via injection nozzles 103 into the reaction chamber. The cross-section area of the reaction chamber is set, relative to the volume of gas being handled, so as to limit the upward flow rate in the reaction chamber to the level where only particles having a mean diameter of 100 microns or less are entrained. The return gas is injected into the reaction chamber tangentially to the walls of said chamber and at a velocity which is about ten times the upward flow velocity, in turn created by the exhaust fan 107. Accordingly a cyclonic flow is created in the reaction chamber. In addition, the injected return gas is angled slightly downward, thus creating a small region of net zero flow 116 near the base of the reaction chamber. Additional injection tubes (not shown) are provided around the base of the reaction chamber and between the return gas injection ports for the purpose of installing burners to supply the required heat input, also in a cyclonic pattern. The solid material to be thermally processed is injected into the system by a feeding device 102 which sprays the finely divided solid matter downward along the axis of the reaction chamber and in a conical pattern. The cyclonic flow of hot gases entrains the particles of material and centrifuges them outward to the wall of the reaction chamber. The downward progress of the particles is a function of the particle size and the net upflow rate of the gases. The height of the reaction chamber is determined by the minimum transit time to achieve the desired reaction. When the particles arrive at the quiescent zone 116 they are then accelerated downward by gravity and fall into the receiving hopper whence they are removed through the side of the apparatus by means of screw conveyor 115. The residual solid material caught by the scrubbing action settles through the liquid 119 to the bottom area 122 of outer shell104 whence it is drawn off through valve 114 to be filtered and returned. An opening with a barometric damper 121 is also provided in the return gas plenum 110 in order to admit a quantity of make-up air equal to the amount of gas exhausted from the system through exit conduit 111.

In both of the embodiments as described in connection with FIGS. 1 and 2 above, it was found generally desirable to operate with the exit gas temperature from the reaction chamber not being less than 800° F. and not more than 1400° F. Also contributing to overall efficient operation and particularly in achieving satisfactory entrainment of the material particles in the carrier gas stream was operation at a maximum amplitude of the velocity vector of the carrier gas in the reaction chamber of 167 feet per second and a minimum amplitude of 80 feet per second when coupled with solid or liquid material particles which do not exceed 5000 microns effective mean diameter as injected into the reaction chamber. Similarly a maximum amplitude of the velocity vector of the carrier gas in the reaction chamber of 200 feet per second and a minimum amplitude of 100 feet per second coupled with solid or liquid material particles which do not exceed 800 microns effective mean diameter as injected into the reaction chamber was also found to produce desirable results.

While there is shown and described herein certain specific structure embodying the invention, it will be manifest to those skilled in the art that various modifications and rearrangements of the parts may be made without departing from the spirit of the underlying inventive concept and that the same is not limited to the particular forms herein shown and described except insofar as indicated by the scope of the appended claims.

What is claimed is:

1. A system for effecting high thermal transfer rates between a solid or liquid and a carrier gas comprising, in combination, a reaction chamber, means for continuously feeding solid or liquid material in a finely divided state in said chamber, means for continuously introducing said gas to said chamber and for establishing and maintaining a high velocity gas stream in said chamber such that substantially all the solid or liquid material is entrained therein, whereby an interaction takes place between said material and said gas, means for controlling the thermal energy content of said material-bearing gas steam, means for recycling a substantial fraction of said material-bearing gas stream, means comprising an exit port and conduit for continuously removing a portion of the gas stream containing entrained solid or liquid material from said reaction chamber, and means for separating said entrained solid or liquid material from said removed portion after removal from said reaction chamber, said reaction chamber being generally toroidally shaped and said carrier gas introduction being through a side wall of a toroidal surface thereof and in the direction of the desired flow, said introduction being at such a flow rate that the desired velocities are established and maintained, the solid or liquid particulate material also being introduced through said side wall of the toroidal chamber and in the same direction of flow as that assumed by the carrier gas, the proportion of material flowing within the toroidal surface relative to the total amount of material introduced therein being controlled by the position and geometry of the exit port and conduit.

2. The system in accordance with claim 1, in which the separation of the entrained solid or liquid material and the gas stream is partially accomplished by a combination of a cyclone separator and a wet scrubber.

3. A system for effecting a high rate of interaction between one or more components of solid or liquid material and one or more components of a carrier gas comprising, in combination, a reaction chamber, means for continuously feeding solid or liquid material in a finely divided state into said chamber, means for continuously introducing said gas to said chamber and for establishing and maintaining a high velocity gas stream in said chamber such that substantially all the solid or liquid material is entrained therein, means for controlling the thermal energy content of said material-bearing gas steam, means for establishing and maintaining recirculation of a substantial fraction of said gas stream containing said entrained solid or liquid material, means comprising an exit port and conduit for continuously removing from said reaction chamber a portion of the gas stream containing entrained solid or liquid material, means for separating said remaining solid or liquid material from said removed portion after removal from said chamber, and means for recycling a substantial fraction of the energy content of said removed stream to said chamber, said reaction chamber being toroidally shaped and the desired recirculation within the chamber being effected by establishing the exit port and conduit of such size and location that a certain total pressure is required at the port opening in order to allow gas to leave the chamber at the same rate at which it is being introduced, said total pressure being comprised of a static pressure and a velocity pressure whereby the system comes to an equilibrium at a certain rate of flow past the exit port, said rate of flow being proportional to the recirculation ratio.

4. The system in accordance with claim 3 in which the separation of the entrained solid or liquid material and the gas stream is partially accomplished by a combination of a cyclone separator and a wet scrubber.

5. The system in accordance with claim 1 in which the separation of the entrained solid or liquid material and the gas stream is partially accomplished by a combination of a cyclone separator and a wet scrubber.

* * * * *